US005282366A

United States Patent [19]

Reilly, Jr. et al.

[11] Patent Number: 5,282,366

[45] Date of Patent: Feb. 1, 1994

[54] TRANSPORTABLE REFRIGERANT TRANSFER UNIT AND METHODS OF USING THE SAME

[75] Inventors: John H. Reilly, Jr., Rosemont, Pa.; Michel J. Maniez, Flemington; George R. Loose, Bridgeton, both of N.J.

[73] Assignee: National Refrigeration Products, Inc., Plymouth Meeting, Pa.

[21] Appl. No.: 868,595

[22] Filed: Apr. 14, 1992

Related U.S. Application Data

[62] Division of Ser. No. 618,193, Nov. 26, 1990, Pat. No. 5,170,632.

[51] Int. Cl.[5] ..... F25B 45/00

[52] U.S. Cl. ..... 62/292; 62/77

[58] Field of Search ..... 62/77, 85, 292, 149, 62/475, 474

[56] References Cited

U.S. PATENT DOCUMENTS

| | | | |
|---|---|---|---|
| 3,232,070 | 2/1966 | Sparano | 62/149 |
| 3,425,238 | 2/1969 | Sylvan | 62/507 |
| 4,170,116 | 10/1979 | Williams | 62/116 |
| 4,242,878 | 1/1981 | Brinkerhoff | 62/119 |
| 4,363,222 | 12/1982 | Cain | 62/292 |
| 4,476,693 | 10/1984 | Johnson | 62/402 |
| 4,480,446 | 11/1984 | Margulefsky et al. | 62/474 |
| 4,550,573 | 11/1985 | Rannenberg | 62/172 |
| 4,566,291 | 1/1986 | Halavais | 62/402 |
| 4,584,838 | 4/1986 | AbuJudom, II | 62/5 |
| 4,766,733 | 8/1988 | Scuderi | 62/77 |
| 4,809,515 | 3/1989 | Houwink | 62/149 |
| 4,856,289 | 8/1989 | Lofland | 62/149 |
| 4,934,390 | 6/1990 | Sapp | 62/77 |
| 4,938,031 | 7/1990 | Manz et al. | 62/145 |
| 4,969,495 | 11/1990 | Grant | 62/292 |
| 5,020,331 | 1/1991 | Michny | 62/77 |
| 5,095,713 | 3/1992 | Laukhuf et al. | 62/149 |
| 5,127,239 | 7/1992 | Manz et al. | 62/292 |

OTHER PUBLICATIONS

"CFC Refrigerant-Depumping-Station Fast 120 Operator's Manual", Fischer Kalte-Klima (Mar. 30, 1989 Germ.).

"Functions of CFC Depumping Station Test 120" US-Version, Fischer Kalte-Klima, Feb. 6, 1990 (5 sheets drawings).

"ACCA Surveys 13 Producers of Recovery/Recycle Units; Criticizes Weight, Speed," *Air Conditioning, Heating & Refrigeration News*, Aug. 1989, pp. 32-33.

"Refrigerant Recovery Systems," Davco Manufacturing Co., Aug. 1989.

"Refrigerant Recovery and Recycling Station, Model No. 17200," Robinair Division, Sealed Power Corp., 1988.

Letter from Wayne Tucker to Michel Maniez, Dec. 18, 1989.

"The Rejuvenator Removes and Cleans Contaminated Refrigerant," Sep. 1987.

"A'Gramkow, Refrigerant reclaim station—RE1215," Jan. 1987.

Letter from Peter P. Scholl to Michel Maniez, Sep. 1989.

"Fishcer informiert, FCKW-Absaugstationen Fur Den Praxisgeriechten Einsatzl" Feb. 1989.

*Primary Examiner*—John M. Sollecito

*Attorney, Agent, or Firm*—Panitch Schwarze Jacobs & Nadel

[57] ABSTRACT

A hand-transportable unit for transferring refrigerants between containers includes a pump to remove refrigerant from a first container. The pump is driven by a pneumatic motor. The pump is capable of transferring refrigerant in liquid form, vapor form, or simultaneously in both forms. A condenser for cooling refrigerant is in fluid communication with the pump. The unit also includes a compressor for driving the pneumatic motor to operate the pump. Optionally, the pump may be powered from an external source of compressed gas. The other components of the unit are mounted to a handcart including a frame and wheels to facilitate movement of the unit. In a preferred embodiment, unit is configured for self-evacuation by use of the pump in order to avoid cross-contamination of different refrigerants during subsequent use of the unit.

5 Claims, 3 Drawing Sheets

TRANSPORTABLE REFRIGERANT TRANSFER UNIT AND METHODS OF USING THE SAME

CROSS REFERENCE TO RELATED APPLICATION

This application is a division of U.S. patent application Ser. No. 07/618,193, filed Nov. 26, 1990 now U.S. Pat. No. 5,170,632.

FIELD OF THE INVENTION

The invention relates to refrigerant transfer units and methods of using the same and, more particularly, to a transportable refrigerant transfer unit and methods of using and evacuating the same.

BACKGROUND OF THE INVENTION

For many years, refrigeration units, such as air conditioners and heat pumps, have used refrigerants consisting of chlorofluorocarbons (CFC's) as heat transfer media. It has recently been discovered that releasing CFC's into the atmosphere damages the ozone layer. Therefore it is necessary to avoid open air release of CFC's during transfer of refrigerant to and from such equipment. A more detailed description of the use of CFC's as refrigerants is discussed in U.S. patent application Ser. No. 478,814, now U.S. Pat. No. 5,020,331 which application is hereby incorporated by reference in its entirety.

U.S. Pat. No. 4,766,733 discloses one type of refrigerant reclamation and charging unit which, rather than using a pump or an auxiliary refrigerant system, utilizes a compressor and condenser and a portion of the refrigerant being evacuated to continuously cool itself. In the reclamation mode, the refrigerant flows in the direction of a standard refrigerant receiver or container by means of a pressure differential created by the cooling.

U.S. Pat. No. 4,363,222 discloses another system and method for withdrawing and charging refrigerant from or into a refrigeration system. Withdrawn refrigerant passes through a vaporizing coil to prevent liquid refrigerant from entering the positive displacement transfer pump. Refrigerant vapor from the pump outlet is liquefied in a cooling coil/heat exchanger, which is, in turn, in communication with a refrigerant disposal storage container.

U.S. Pat. No. 4,938,031 discloses another refrigerant recovery and purification system which consists of an evaporator, a compressor and a condenser, mounted on a two-wheel hand truck. Refrigerant is passed through the evaporator, compressed by the compressor, reliquified at the condenser and fed to a storage container.

U.S. Pat. No. 3,232,070 discloses a device for pumping refrigerant from a refrigeration system. The device comprises a compressor, a condenser, and a drier/-strainer mounted on a hand movable, two-wheel cart. Refrigerant is withdrawn from the refrigeration system by the compressor until the refrigerant pressure within the system decreases below atmospheric pressure when the device is cut off. If pressure within the system rebuilds, the device is again activated until the system pressure again drops below atmospheric pressure. The patent further teaches keeping a small amount of refrigerant in the device between uses to keep out moisture and air.

None of the above-discussed refrigerant transfer units enables refrigerant to be efficiently pumped in liquid form or simultaneously in both liquid and vapor forms.

Consequently, transfer rates are low, a pound or two per minute at an absolute maximum and typically less. None of the above-described, prior art transfer units are capable of essentially complete evacuation in order to prevent contamination between different types of refrigerants during subsequent transfers. Industry standards currently call for no more than about one-half of one percent contaminating (dissimilar) refrigerant(s). The addition of even small amounts of dissimilar refrigerants into the refrigerant of a relatively large industrial or commercial refrigeration system is not likely to contaminate the system refrigerant sufficiently to drop it below industry standards. However, since the direction of the industry is towards reconditioning and recycling of refrigerant, contamination will become cumulative. Generally speaking, mixed refrigerants cannot be separated economically and returned to industry standard levels for reuse. When finally contaminated, such mixed refrigerants will have to be safely disposed of, also typically at a significant cost.

SUMMARY OF THE INVENTION

One aspect of the present invention is a refrigerant transfer unit for transferring refrigerant between containers comprising: a pump having a pump inlet to receive refrigerant and a pump outlet to expel refrigerant, the pump being adapted to transfer refrigerant between the inlet and the outlet in liquid form, in vapor form, and simultaneously in both forms; pump driving means coupled with the pump for driving the pump; refrigerant cooling means in communication with the pump outlet for cooling the refrigerant from the pump and condensing refrigerant received from the pump in vapor form; and hand cart means for moving the unit by hand, the hand cart means including frame means for mounting and supporting the pump, the pump driving means and the refrigerant cooling means.

Another aspect of the invention is a method of transferring refrigerant from a first container to a second container, the method comprising the steps of: simultaneously removing refrigerant in liquid and vapor form from the first container with a single pump; passing the removed liquid and vapor form refrigerant simultaneously through the pump from the first container to a condenser; condensing the vapor form refrigerant to liquid form in the condenser; and conducting the liquid form refrigerant from the condenser to the second container.

A further aspect of the present invention is a refrigerant transfer unit for transferring refrigerant between containers comprising: refrigerant transfer means having an inlet and an outlet, the transfer means receiving a refrigerant at the inlet at a first pressure and expelling refrigerant from the outlet at a second pressure higher than the first pressure; an inlet conduit having a first end to receive refrigerant into the unit and a second end in communication with the transfer means inlet; an outlet conduit having a third end in communication with the transfer means outlet and a fourth end to discharge refrigerant from the unit; a first junction in the inlet conduit between the first and second ends; second, third and fourth junctions sequentially located in the outlet conduit between the third and fourth ends; first valve means in the outlet conduit between the second and third junctions for controlling refrigerant flow between the second and third junctions; second valve means in the outlet conduit between the third and fourth junctions for controlling refrigerant flow between the fourth and third junctions; a return conduit extending between the first and third junctions; third valve means in the return conduit for controlling the flow of refrigerant through the return conduit; a by-pass conduit extending between the second and fourth junctions, the by-pass conduit having a length less than a length of the output conduit between the second to the fourth junctions; and fourth valve means in the by-pass conduit for controlling refrigerant flow through the by-pass conduit.

Another aspect of the invention is a method for evacuating a refrigerant transfer unit including refrigerant transfer means having an inlet and an outlet, the transfer means receiving a refrigerant at the inlet at a first pressure and expelling refrigerant from the outlet at a second pressure higher than the first pressure, an inlet conduit having a first end to receive refrigerant into the unit and a second end in communication with the transfer means inlet, an outlet conduit having a third end in communication with the transfer means outlet and a fourth end to discharge refrigerant from the unit, a first junction in the inlet conduit between the first and second ends, second, third and fourth junctions sequentially located in the outlet conduit between the third and fourth ends, first valve means in the outlet conduit between the second and third junctions for controlling refrigerant flow between the second and third junctions, second valve means in the outlet conduit between the third and fourth junctions for controlling refrigerant flow between the fourth and third junctions, a return conduit extending between the first and third junctions, third valve means in the return conduit for controlling flow of refrigerant through the return conduit, a by-pass conduit extending between the second and fourth junctions, the by-pass conduit having a length less than a length of the output conduit between the second to the fourth junctions, and fourth valve means in the by-pass conduit for controlling refrigerant flow through the by-pass conduit.

Another aspect of the invention is a method for evacuating a refrigerant transfer unit, the unit including refrigerant transfer means having an inlet and an outlet, the transfer means receiving a refrigerant at the inlet at a first pressure and expelling refrigerant from the outlet at a second pressure higher than the first pressure, an inlet conduit having a first end to receive refrigerant into the unit and a second end in communication with the transfer means inlet, an outlet conduit having a third end in communication with the transfer means outlet and a fourth end to discharge refrigerant from the unit, a first junction in the inlet conduit between the first and second ends, second, third and fourth junctions sequentially located in the outlet conduit between the third and fourth ends, first valve means in the outlet conduit between the second and third junctions for controlling refrigerant flow between the second and third junctions, second valve means in the outlet conduit between the third and fourth junctions for controlling refrigerant flow between the fourth and third junctions, a return conduit extending between the first and third junctions, third valve means in the return conduit for controlling flow of refrigerant through the return conduit, a by-pass conduit extending between the second and fourth junctions, the by-pass conduit having a length less than a length of the output conduit between the second and fourth junctions, and fourth valve means in the by-pass conduit for controlling refrigerant flow through the by-pass conduit, the method comprising the steps of: configuring the first valve means to prevent refrigerant flow therethrough between the second and third junctions, the second valve means to prevent refrigerant flow therethrough between the fourth and third junctions, the third valve means to permit refrigerant flow therethrough and through the return conduit, and the fourth valve means to permit refrigerant flow therethrough and through the by-pass conduit; and actuating the refrigerant transfer means so as to expel refrigerant from the outlet conduit between the first and second valves and from the return conduit through the refrigerant transfer means.

BRIEF DESCRIPTION OF THE DRAWINGS

The foregoing summary, as well as the following detailed description of the preferred embodiment, will be better understood when read in conjunction with the appended drawings. For the purpose of illustrating the invention, there is shown in the drawings an embodiment which is presently preferred, it being understood, however, that the invention is not limited to the specific methods and instrumentalities disclosed. In the drawings.

DESCRIPTION OF THE PREFERRED EMBODIMENTS

Figure 1:
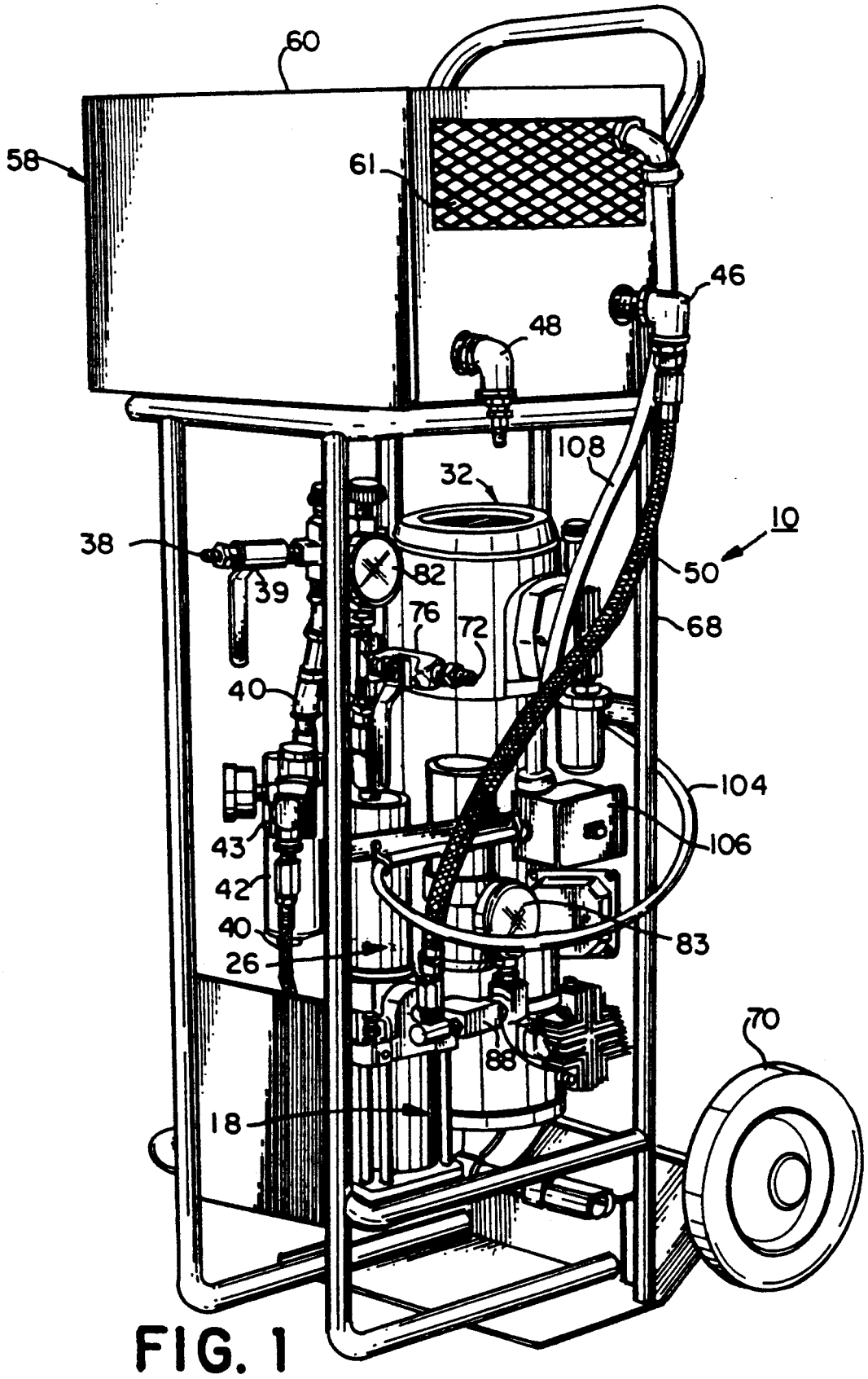
FIG. 1 is a perspective view of a refrigerant transfer unit.
Figure 2:
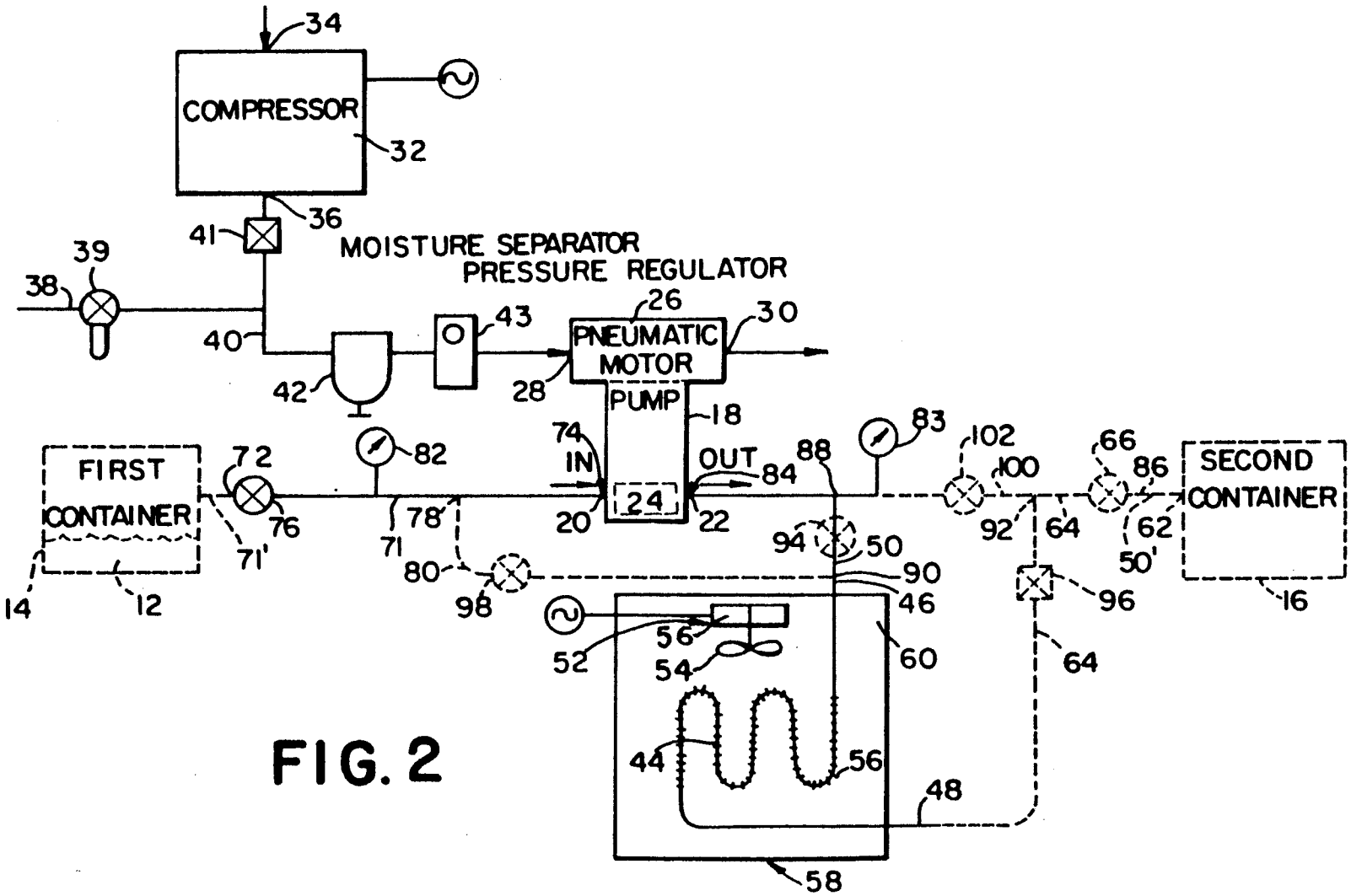
FIG. 2 is a schematic diagram of the refrigerant transfer unit of FIG. 1 with suggested modifications.

Referring to the drawings, wherein like numerals indicate like elements throughout, there is shown in FIGS. 1 and 2 a preferred embodiment of a basic refrigerant transfer unit, generally designated 10, in accordance with the present invention. The refrigerant transfer unit 10 is preferably used for transferring refrigerant 12 between a first container 14 and a second container 16. "Container" is being used in the broadest sense. One of the "containers" 14 and 16 may be and typically is a refrigeration system, such as an air conditioner, heat pump refrigerator and the like. The other "container" is typically a refrigerant storage cylinder. However, the present refrigerant transfer unit 10 is not limited to any particular type of refrigeration system and can be used in connection with any conventional refrigerant container, as is understood by those of ordinary skill in the art.

The refrigerant 12 to be transferred (see FIG. 2) is preferably of the high pressure type which exist as both a liquid and a gas at room temperature within the pressurized refrigeration system. It will be understood by those skilled in the art that the present invention is applicable to transferring a wide variety of refrigerants including R-11, R-12, R-22, R-500, R-502, as well as the newer R-123 and R-134A refrigerants being introduced to replace R-11 and R-12, and other types of refrigerants well known to those skilled in the art.

The refrigerant systems with which the transfer unit 10 would typically be used would be a commercial refrigeration system such as that used for food cooling or air conditioning, the system containing approximately 100 to 2000 lbs of refrigerant. Details regarding the type of refrigeration system are not specifically pertinent to an understanding of the present invention and, in any event, are understood by those skilled in the art. It will be further understood by those skilled in the art that the present refrigerant transfer unit 10 may be used to transfer less than 100 lbs or greater than 2000 lbs of refrigerant 12. The above description is not intended to be limiting.

As shown in FIG. 1, the refrigerant transfer unit 10 includes a refrigerant transfer means comprising a pump 18 for transferring refrigerant 12 from the first container 14 to the second container 16. As best shown in the schematic diagram of FIG. 2, the pump 18 has an pump inlet 20 to receive refrigerant 12. The pump 18 also includes a pump outlet 22 to expel refrigerant 12. Preferably the pump 18 is configured so as to be capable of producing a subatmospheric pressure or partial vacuum at the pump inlet 20 for drawing the refrigerant 12 into the pump 18. The pump 18 transfers or moves refrigerant 12 through the remainder of the refrigerant transfer unit 10 by expelling refrigerant at the pump outlet at a pressure above atmospheric pressure and above the pressure at the pump inlet 20.

In the presently preferred embodiment, the pump 18 is preferably driven by a pneumatic motor 26, described in more detail hereinafter. The preferred pump 18 and pneumatic motor 26 are integrally combined as a single unit and commercially available with neoprene refrigerant seals as Model No. 57732 from the manufacturer, Haskel, Inc. of Burbank, Calif. This is a basic Haskel Model No. 4AGT-¾ pump with neoprene seals fitted on the working side of the pump.

The preferred pump 18 is capable of handling refrigerant 12 in liquid form, vapor form, or simultaneously in both forms. In addition, the pump 18 may handle mixed refrigerants 12. The preferred pump 18 is capable of transferring approximately eight pounds of liquid refrigerant per minute, although one of ordinary skill in the art would understand that a substantially similar pump 18 differing only in size may be used to transfer at a higher or lower rate of transfer.

In the present embodiment, it is preferred that the pump 18 include neoprene seals for pumping refrigerants such as R-12, R-22, R-500, and R-502. It is further preferred that the seals be made from Buna-N for pumping refrigerants of the type R-11 and R-112. It is understood by one skilled in the art that the pump 18 may include seals made from other materials such as polytetrafluoroethylene, "VITON", "RYTON", and "UHMWPE", for example, and that the material(s) selected should be compatible with the refrigerant(s) to be transferred.

The refrigerant transfer means of the presently preferred transfer unit 10 includes, in addition to the pump 18, pump driving means comprising a pneumatic motor 26. As best shown in FIG. 2, the pneumatic motor 26 has a gas inlet 28 for receiving compressed gas and a gas outlet 30 for discharging gas, preferably through a muffler, not depicted. The presently preferred Haskell Model No. 57732 combines the motor 26 and the pump 18 in a single assembly with a common, two-headed piston. It will be understood by those skilled in the art, however, that other types of known pumps and pump driving means could be utilized in or with the present invention. The specific internal configurations and elements of such known pumps and pump driving means are within the knowledge of those of ordinary skill in the pump art and, therefore, further description thereof is neither believed to be necessary or limiting.

As shown in FIG. 1, the pump driving means of unit 10 preferably further comprises an air compressor 32 for driving the motor 26. As best shown in FIG. 2, the compressor 32 has a compressor inlet 34 for drawing in outside air and a compressor outlet 36 in communication with the gas inlet 28 of the motor 26. The compressor 32 presently preferred is commercially available from W. W. Granger, Inc., Chicago, Ill. as Dayton Brand Model No. 4Z460. The presently preferred compressor is electrically powered by a 1½ horsepower motor and is capable of outputting 7 cubic feet per minute of compressed air at a pressure of 40 psi. The preferred compressor 32 is oil-less, using Teflon TM bearings and can be mounted in virtually any orientation, including on-end, as is depicted in FIG. 1, for operation. It is believed that such compressors can be obtained from other commercial sources including but not limited to Bell & Gossett ITT of Morton Grove, Ill.

Compressed air produced during operation of the compressor 32 is conducted to the gas inlet 28 of the motor 26 for driving the motor 26 to drive the pump 18 in order that the refrigerant 12 be removed from the first container 14 and passed through the remainder of the refrigerant transfer unit 10 to the second container 16.

Unit 10 is also preferably provided with an external gas supply inlet 38 through which compressed gas from another source could alternatively be supplied to the gas inlet 28 of the motor 26. While compressed air is preferred, one of ordinary skill in the art would understand that other compressible gases, such as nitrogen, may be used to power to the pneumatic motor 26 without departing from the spirit and scope of the invention.

As best shown in FIG. 2, a compressed air conduit 40 is interposed between the compressor outlet 36 and the gas inlet 28 of the motor 26 for passing compressed gas 33 therebetween. The conduit 40 preferably includes a check valve 41 for allowing compressed gas to flow from the compressor 32 to the gas inlet 28 of the motor 26. Valve 41 holds air in compression in line 40 and further prevents compressed gas from the external gas supply inlet 38 from passing into the compressor 32 possibly damaging the compressor 32. The external gas supply inlet 38 includes an external supply valve 39 having an open position s that external gas may be supplied to the motor 26 and a closed position when compressed air 33 is to be supplied by the compressor 32 to the motor 26.

In the presently preferred embodiment, the compressor valve 41 is a check valve and the external supply valve 39 is a hand-operated ball valve but could also be a check valve. It should be understood that any other suitable type of valve could be used as the compressor valve 41 or the external supply valve 39. In the present embodiment, it is further preferred that the valve 41 be manually operated. However, it should be understood that valves 39, 41 and many of the other valves to be described may be controlled automatically with solenoids.

A moisture separator 42 and a pressure regulator 43 are also preferably provided along conduit 40 to protect the pneumatic motor 26.

The refrigerant transfer unit 10 preferably further includes a refrigerant cooling means in communication with the pump outlet 22 for receiving and cooling refrigerant expelled from the pump 18 and condensing refrigerant 12 received in vapor form to a liquid form. As best shown in FIG. 2, the preferred refrigerant cooling means comprises a condenser coil indicated generally at 44 equipped with cooling fins 56, in communication with the pump outlet 22, and air cooling means indicated generally at 52 for cooling the coil 44. The condenser coil 44 includes a condenser inlet 46 in communication with the pump outlet 22 and a condenser outlet 48. More particularly, the condenser coil 44 is preferably part of an outlet conduit, indicated generally at 50, in communication with the pump outlet 22. As is shown in FIG. 1, the condenser inlet 46 is preferably located at a higher elevation than the condenser outlet 48 for assisting in the flow of refrigerant through the condenser coil 44.

In the present embodiment, it is preferred that the air cooling means 52 comprises a bladed fan 54 positioned to direct air on the condenser coil 44. It is presently preferred that the fan 54 be powered by a fan motor 56 which is electrically driven. However, it should be understood that the fan 54 may be driven by a pneumatic motor or hydraulic motor, or by any other means in keeping with the spirit and scope of the invention.

In the present embodiment, it is preferred that the air cooling means 52 and condenser coil 44 be positioned within a housing 58, as best shown in FIG. 1. As best shown in FIG. 2, it is preferred that the fan motor 56 be mounted at the top 60 of the housing 58 for forcing the air downwardly onto the condenser coil 44 in order to cool the coil 44. It is further desired that the housing 58 include apertures, one being depicted at 61, extending through the housing 58 for providing the fan 54 with a source of air. As best shown in FIG. 1, it is preferred that the pump 18 and compressor 32 be positioned beneath the refrigerant cooling means such that the air from the fan 52 also flows upon them.

The pump 18 conveys liquid refrigerant 12 from the refrigerant cooling means to the second container 16 for storing liquid refrigerant 12, as is understood by those skilled in the art. The second container 16 has an inlet 62 in fluid communication with the unit 10 for receiving cooled refrigerant 12 therefrom. The condenser outlet 48 is provided by a fitting bearing the same number in FIG. 1. In the present embodiment, it is preferred that the second container 16 be in fluid communication with the condenser outlet 48 by a portion 64 of the outlet conduit 50 interconnected therebetween. Outlet conduit portion 64 is not depicted in FIG. 1 but is shown in phantom in FIG. 2.

As best shown in FIG. 1, the refrigerant transfer unit 10 preferably further comprises a handcart means for moving the unit 10 by hand. The handcart means preferably comprises a frame means, or simply, frame, indicated at 68, for mounting and supporting the other components of the unit 10 including the pump 18, the pump driving means formed by the compressor 32 and the pneumatic motor 26 and the refrigerant cooling means formed by the housing 58, air cooling means 52 and condenser coil 44. The handcart means further comprises a pair of wheels 70 coupled with the frame 68, one of which can be seen in FIG. 1. In the presently preferred embodiment, the frame 68 is made from welded steel tubing, although it should be understood that the frame 68 may be made from aluminum or any other material capable of supporting the remaining components of the preferred refrigerant transfer unit 10.

The refrigerant transfer unit 10 depicted in FIGS. 1 and 2 further preferably includes an inlet conduit 71 having a first end 72 in the form of a male threaded fitting to receive refrigerant 12 into the unit 10 and a second end 74 (see FIG. 2) in communication with the pump inlet 20, preferably directly coupled with the pump inlet 20. An inlet valve 76 is preferably provided on the unit 10 for controlling the flow o refrigerant 12 from the first container 14 and to close off the refrigerant input side of the unit 10. In the present embodiment, it is further preferred that a pressure indicator 82, such as a pressure gauge, be located between the inlet valve 76 of the second end 74 of the inlet conduit 71 to measure refrigerant pressure within that portion of the conduit 71. A similar pressure indicator 83 is preferably provided on the outlet side of the pump 18.

The preferred embodiment unit 10 depicted in FIG. 1 and in solid in FIG. 2 would be operated by coupling a first container 14 containing a refrigerant 12 to the first end 72 of the unit 10 by suitable means such as an inlet connector conduit, indicated in FIG. 2 in phantom at 71', having a fitting matable with the fitting forming the first end 72 of the inlet conduit 71 and coupled in a suitable, conventional manner to the first container 14. The inlet connector conduit may include a fitting for connection with a refrigerant service fitting (liquid or vapor) on a low pressure side of a refrigeration system. See U.S. patent application Ser. No. 477,681 filed Feb. 2, 1990 and incorporated by reference herein. Portion 64 of the outlet conduit 50 between fitting 48 and container 16 also would have suitable fittings to be coupled between the condenser outlet fitting 48 and the second container 16 which will receive the refrigerant 12 from first container 14. The refrigerant circuit in this configuration of the unit 10 includes inlet connector conduit 71', inlet conduit 71, pump 18, outlet conduit 50 and the portion 64 of the outlet conduit. Inlet valve 76 and all other valves along that path would be open to permit the refrigerant 12 to be moved from the first container 14 by the pump 18 to the second container 16.

The basic unit 10 differs from prior art refrigerant transfer units in that the particular preferred pump identified above is capable of transferring the refrigerant in liquid form, in vapor form or simultaneously in liquid and vapor form. The described preferred pump is capable of transferring refrigerant in all such forms without being switched in configuration or operating mode. Moreover, the basic unit 10 is self-contained needing only to be plugged into a conventional 110 or 220 VAC power supply for operation. Referring to FIG. 1, a main power cord 104 with plug (not depicted) is connected to an ON-OFF switch 106. Line 108 carries current to fan motor 56 while another line (not depicted) extends to compressor 32. The preferred compressor 32 and fan motor 56 should be capable of being operated by conventional 110/220 VAC.

FIG. 2 further depicts in phantom a preferred embodiment of a second aspect of the present invention which is a modification to the basic refrigerant transfer unit 10 depicted in FIG. 1 to provide a self-cleansing or self-evacuating capability. In this aspect of the invention, it is preferred that a first junction 78 be located between the first and second ends 72, 74 of the inlet conduit 71. The first junction 78 is preferably a "T" shaped tubular fitting for connection of a return conduit, indicated in phantom at 80, to the inlet conduit 70. Outlet conduit 50 has a third end 84 in communication with, preferably directly coupled with pump outlet 22 and a fourth end 86 to discharge refrigerant 12 from the unit 10 into the second container 16. It is further preferred that at least part of previously described portion 6 be provided on unit 10 coupled with condenser outlet 48, forming an integral part of the outlet conduit 50 and providing a fourth end of outlet conduit 50, indicated at 86. It is further preferred that second, third and fourth junctions 88, 90, 92, respectively, be sequentially located in the outlet conduit 50 between the third end 84 and the fourth end 86. Second junction 88 is actually present in the unit 10 shown in FIG. 1 between pump 18 and the condenser 44. All of the aforementioned junctions, 88, 90, 92 are generally "T" shaped, although one of ordinary skill in the art would understand that these junctions may occur at any angle in keeping with the spirit and scope of the present invention.

Preferably, a first valve means, indicated in phantom at 94, is provided in the outlet conduit 50 between the second and third junctions 88, 90 for controlling refrigerant 12 flow between the second and third junctions 88, 90. Preferably, a second valve means, indicated in phantom at 96, is provided in the outlet conduit 50 between the third and fourth junctions 90, 92 for controlling refrigerant 12 from flowing between the fourth and third junctions 92 and 90, respectively.

Preferably, a return conduit 80 is provided extending between the first and third junctions 78, 90. Preferably, a third valve means, indicated in phantom at 98, is provided for controlling flow of refrigerant 12 through the return conduit 80.

Preferably, a by-pass conduit 100 is provided extending between the second and fourth junction 88, 92. The by-pass conduit 100 has a length less than the length of the output conduit 50 between the second and fourth junctions 88, 92, and preferably, as short a length as possible, to minimize the amount of refrigerant which remains in the unit 10 after self-evacuation. Preferably, fourth valve means 102 is provided in the by-pass conduit 100 for controlling refrigerant flow through the by-pass conduit 100 between the second and fourth junctions 88 and 92.

While one of ordinary skill in the art would understand that any type of valve, which performs in a manner compatible with operation of the system being described, may be used for the first, second, third or fourth valves 94, 96, 98 and 102, it is presently preferred that the second valve means 96 be a check valve to simply prevent refrigerant 12 from flowing back to the condenser coil 44 and third junction 90 from the fourth junction 92. If desired, a separate outlet valve 66 can be provided on the unit 10. Alternatively, the outlet valve 66 can be a shut-off valve provided on the container 16 and not part of the unit 10. Preferably, an outlet connector conduit 50' is further provided extending to the second container 16 from fourth end 86 of the outlet conduit 50, which is preferably provided by a suitable fitting (not depicted) which would be fixedly mounted on the unit 10.

The method according to the present invention of operating and self-evacuating or self-cleaning of the refrigerant transfer unit 10 equipped with these additional conduits 64, 80 and 100, junctions 78, 88, 90 and 92 and valves 94, 96, 98 and 102 will now be described generally with reference to FIG. 2.

The modified refrigerant transfer unit 10 is preferably connected to the first container 14 with the inlet valve 76 in the closed position and the outlet conduit 50 is connected to the second container 16. Where provided, the outlet valve 66 may be opened. The compressor 32, connected to the gas inlet 28 of the pneumatic motor 26 by the compressed gas conduit 40, is activated with valve 39 closed or an independent compressed air source is coupled to inlet 38 and valve 39 opened. This causes compressed air or gas to flow through the compressed gas conduit 40, which includes the moisture separator 42 and the pressure regulator 43, to the gas inlet 28 of the pneumatic motor 26, thereby actuating the pump 18.

In the refrigerant transfer mode of operation, valves 98 and 102 are closed and valves 94 and 66 are opened. With the refrigerant transfer unit 10 now ready for operation, the inlet valve 76 and any other valve associated with the first container 14 is or are opened so that the pump 18 is in communication with and begins removing the refrigerant 12 from container 14. The outlet valve 66 and/or any valve associated with second container 16 is or are then opened, if not already opened, passing the refrigerant 12 from the outlet conduit 50, including portion 64, and connector conduit 50' into the second container 14. The user monitors the pressure indicator 82 in order to determine whether the refrigerant 12 has been completely removed from the first container 14. When it appears that the pump 18 is no longer removing refrigerant 12 by the presence of a partial vacuum in line 71, the inlet valve 76 is placed in the closed position. The first container 14 may be disconnected from the refrigerant transfer unit 10.

The refrigerant transfer unit 10 is then configured for self-evacuation or self-cleaning. The first valve 94 in the outlet conduit 50 is placed in the closed position and third and fourth valves 98 and 102 placed in the open condition. In this configuration, the inlet or vacuum side 20 of the pump 18 is coupled through return conduit 80 to the portion of the outlet conduit 50 which extends between first valve 94 and second valve 96 and which include the condenser coil 44. In this configuration, continued operation of the pump 18 evacuates that portion of the system thus coupled to the pump inlet 20 and expels the refrigerant through the portion of the outlet conduit 50 between the pump outlet 22 and second junction 88, the by-pass conduit 100 and any remaining part of the portion 64 of the outlet conduit 50, which extends beyond the fourth junction 92 to the fourth end 86 of the outlet conduit 50, and connector conduit 50' to the second container 16. Check valve 96 prevents any back flow of refrigerant from the fourth to the third junction, respectively. The above described expulsion path is preferably made as short as possible so as to minimize the amount of refrigerant which remains in the unit 10 when it is disconnected from the second container 16 after valve 102 and valve 66, if provided, are closed.

The self-evacuation of refrigerant 12 from the refrigerant transfer unit 10 is particularly important in order to minimize cross-contamination from different refrigerants 12 which may be transferred in subsequent operations of the refrigerant transfer unit 10. It is very difficult to separate different refrigerants. Therefore the modified refrigerant transfer unit 10 which is capable of being evacuated is particularly beneficial. The modified refrigerant transfer unit 10 can transfer large quantities of refrigerant 12 between containers in an efficient manner. It is not necessary to evaporate or condense the refrigerant 12 being introduced into the preferred pump 18 as the preferred pump 18 is capable of pumping refrigerant 12 in liquid form, vapor form, or simultaneously in both forms. By removing refrigerant from containers in both the liquid and gaseous form, the refrigerant transfer unit 10 is particularly successful in removing almost all of the refrigerant 12 from containers, thereby promoting environmental safety.

Figure 3:
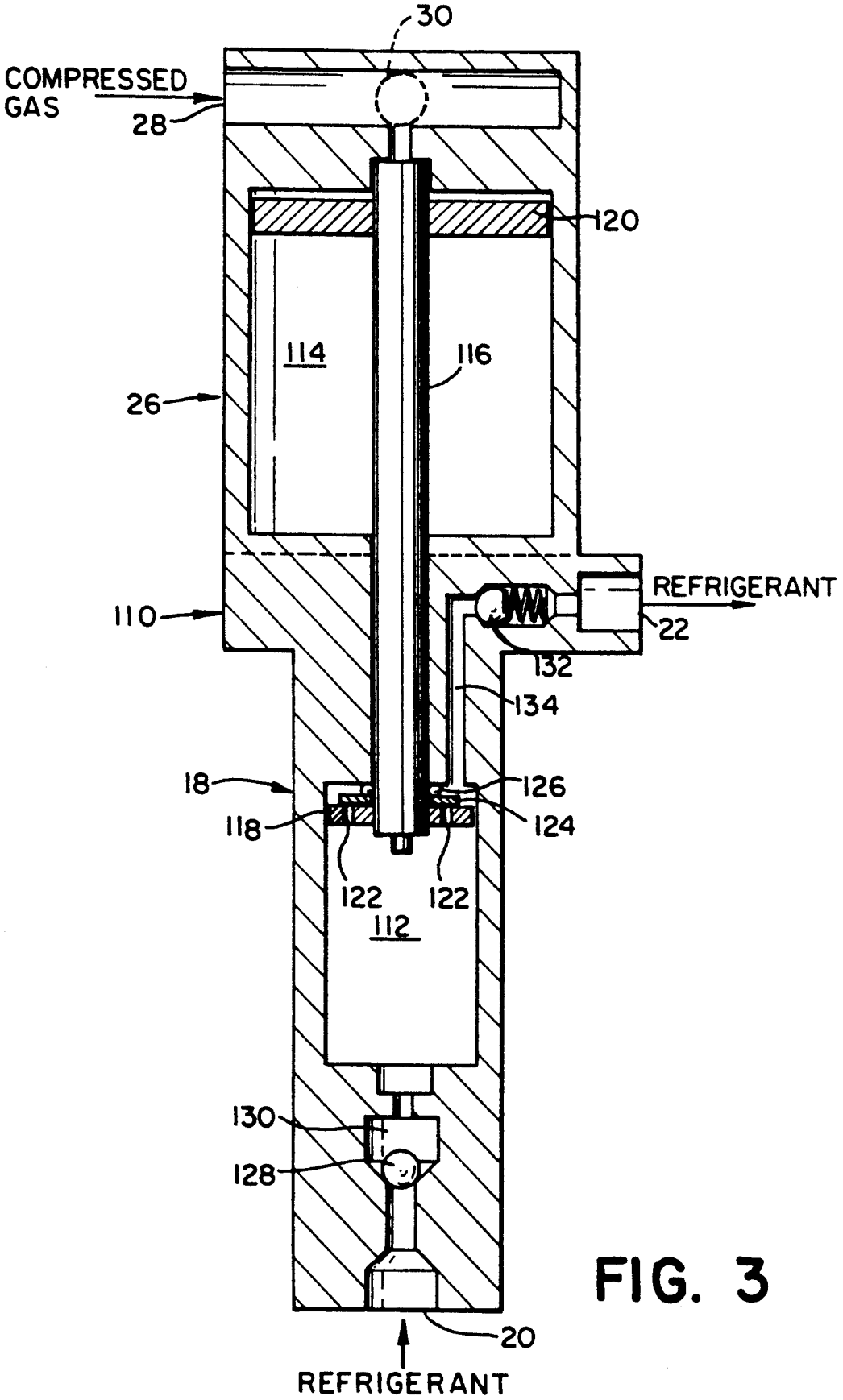
FIG. 3 is a diagrammatic representation of the preferred combined pump/pneumatic motor.

FIG. 3 depicts diagrammatically the major components of the preferred Haskel pump 18 and its integral pneumatic motor 26. An integral housing, indicated generally at 110 and assembled from a plurality of separate components combined with appropriate seals (neither depicted), contains a working or refrigerant pump chamber 112 and a pneumatic motor chamber 114. A single shaft 116 supports two pistons, a piston 118 in the refrigerant pump chamber 112 and a piston 120 in pneumatic motor chamber 114, for simultaneous reciprocation. Refrigerant piston 118 includes one or more passages axially therethrough, indicated generally at 122. A spring-loaded valve is effectively provided by a flexible annular seal member 124 on a "back" side (upper side in FIG. 3) of piston 118 and a spring member 126, indicated diagrammatically. Spring member 126 forces the seal member 124 against the face of the piston. A ball-type refrigerant inlet check valve, indicated generally at 128, is provided along a passageway, indicated generally at 130, extending from the pump inlet 20 into the refrigerant pump chamber 112. A spring-loaded, ball-type refrigerant outlet check valve, indicated generally at 132, is provided at the end of the passageway 134 extending from the refrigerant pump chamber 112 to the pump outlet 22. Check valve 128 may also be spring loaded, if desired. The inlet 20 and outlet 22 are suitable configured to receive male pipe threaded fittings.

Operation of the pump 18 is as follows. When the piston 118 is depressed (lowered in FIG. 3), any refrigerant in chamber 112 trapped by check valve 12 and piston 118 is forced through passages 122 overcoming the bias of spring 126 on seal member 124 thereby moving member 124 from the adjoining face of the piston 118. Refrigerant flows to a position behind (above in figure) the piston 118. If chamber 112 is initially filled with refrigerant, at least a portion of the refrigerant passing through passages 122 is displaced by the shaft 116 and forced through the check valve 132. On the return stroke, refrigerant "above" piston 118 in chamber 112 forces seal 124 against the passages 122 with spring 126, thereby closing passages 122 and permitting a vacuum to be created below the piston 118 in FIG. 3 drawing refrigerant through check valve 128. Refrigerant trapped above the piston 118 in chamber 112 is forced under pressure through the check valve 132. The above-described Haskel pump is capable of transferring refrigerant in liquid form, vapor form or simultaneously in both forms and is equally capable of receiving refrigerant at several hundred psi or generating twenty inches or more of vacuum to suck refrigerant and expel it against several hundred psi of back pressure. Seal member 124 and any other type of flexible seal type members, such as piston 118 and/or O-rings, which are typically provided in such devices for assembly and are, in fact, provided in the aforesaid Haskel device, are preferably made of either Buna-N or neoprene material.

Pneumatic motor piston 120 is reciprocated in chamber 114 through a valve and conduit system (not depicted) which includes an unbalanced spool and a pilot valve. These cooperate to route air from gas inlet 28 alternatively to chamber 114 on either side of piston 120 while venting chamber 114 on a remaining side of the piston 120 through gas outlet 30 to atmosphere.

From the foregoing description, it can be seen that the present invention comprises a refrigerant transfer unit 10 and methods of operating and evacuating the same. While transferring refrigerant from a refrigeration unit to a storage cylinder has been described, the unit 10 in basic or modified form is equally capable of transferring refrigerant from a conventional storage cylinder or other container into a refrigeration unit. As recognized by those skilled in the art, that changes may be made to the above-described embodiment of the invention without departing from the broad inventive concept thereof. It is understood, therefore, that this invention is not limited to the particular embodiment disclosed, but is intended to cover all modifications which are within the spirit and scope of the invention, as defined by the appended claims.

We claim:

1. A refrigerant transfer unit comprising:

a refrigerant inlet to the unit;

a refrigerant outlet from the unit;

a refrigerant transfer device having an inlet receiving refrigerant at a first pressure and an outlet expelling refrigerant at a second pressure higher than the first pressure;

an inlet conduit from the unit inlet to the refrigerant transfer device inlet, the inlet conduit lacking any chamber capable of receiving and holding liquid refrigerant received from the unit inlet for evaporation by the transfer device;

an outlet conduit from the refrigerant transfer device outlet to the unit outlet;

a refrigerant return conduit fluidly coupling the outlet conduit with the inlet conduit;

a refrigerant by-pass conduit fluidly coupling together spaced-apart portions of the outlet conduit, the spaced-apart portions being on either side of an intermediate portion of the outlet conduit and on either side of a junction between the intermediate portion and the refrigerant return conduit, the refrigerant by-pass conduit having a length shorter than a length of the intermediate portion of the outlet conduit between ends of the by-pass conduit; and a refrigerant treatment device fluidly coupled in the intermediate portion of the outlet conduit.

2. The refrigerant transfer unit of claim 1 wherein the refrigerant treatment device is a condenser.

3. The refrigerant transfer unit of claim 1 further comprising valving coupled with the conduits at locations permitting selective direction of refrigerant along one of a first path from the unit inlet through the inlet conduit to the refrigerant device inlet and from the refrigerant transfer device outlet through the spaced-apart portions of the outlet conduit and the refrigerant by-pass conduit to the unit outlet.

4. The refrigerant transfer unit of claim 1 wherein the refrigerant transfer device is a refrigerant pump.

5. The refrigerant transfer unit of claim 4 wherein the refrigerant pump has a single configuration in which the pump transfers refrigerant between the pump inlet and the pump outlet in liquid form, in vapor form, and simultaneously in both forms without change in configuration.

* * * * *